US011167893B2

(12) United States Patent
Miyawaki

(10) Patent No.: US 11,167,893 B2
(45) Date of Patent: Nov. 9, 2021

(54) SPOUT CAP, SPOUT, AND CONTAINER WITH SPOUT

(71) Applicant: HOSOKAWA YOKO CO., LTD., Tokyo (JP)

(72) Inventor: Ryosuke Miyawaki, Tokyo (JP)

(73) Assignee: HOSOKAWA YOKO CO., LTD., Tokyo (JP)

( * ) Notice: Subject to any disclaimer, the term of this patent is extended or adjusted under 35 U.S.C. 154(b) by 52 days.

(21) Appl. No.: 16/635,762

(22) PCT Filed: Aug. 1, 2018

(86) PCT No.: PCT/JP2018/028868
§ 371 (c)(1),
(2) Date: Jan. 31, 2020

(87) PCT Pub. No.: WO2019/026965
PCT Pub. Date: Feb. 7, 2019

(65) Prior Publication Data

US 2021/0086967 A1 Mar. 25, 2021

(30) Foreign Application Priority Data

Aug. 2, 2017 (JP) ..... JP2017-150060

(51) Int. Cl.
*B65D 1/20* (2006.01)
*B65D 51/20* (2006.01)
(Continued)

(52) U.S. Cl.
CPC ..... *B65D 51/20* (2013.01); *B65D 5/74* (2013.01); *B65D 51/185* (2013.01)

(58) Field of Classification Search
CPC .... B65D 47/141; B65D 47/121; B65D 41/60; B65D 41/58; B65D 41/30; B65D 41/28;
(Continued)

(56) References Cited

U.S. PATENT DOCUMENTS 4,782,968 A 11/1988 Hayes
8,297,456 B1 * 10/2012 Anderson ..... B65D 51/222 215/227
(Continued)

FOREIGN PATENT DOCUMENTS

CN 2644340 9/2004
CN 201512169 6/2010
(Continued)

OTHER PUBLICATIONS

European Search Report (Application No. 18841527.7) dated Mar. 29, 2021.
(Continued)

*Primary Examiner* — Kareen K Thomas
(74) *Attorney, Agent, or Firm* — Nixon Peabody LLP; Jeffrey L. Costellia

(57) ABSTRACT

A spout cap is a spout cap for closing a mouth portion of a spout main body, and includes a cylindrical body portion made of resin, and a sealing film joined to the body portion, in which the sealing film has a thermal bonding layer which is configured to join to a distal end surface of the mouth portion when the mouth portion is closed.

9 Claims, 8 Drawing Sheets

(51) Int. Cl.
*B65D 5/74* (2006.01)
*B65D 51/18* (2006.01)

(58) Field of Classification Search
CPC .... B65D 39/0035; B65D 33/16; B65D 5/727; B65D 51/20; B65D 5/74; B65D 51/185; B65D 75/5883; B65D 41/0485; B65D 41/045; B65D 41/0492
See application file for complete search history.

(56) References Cited

U.S. PATENT DOCUMENTS 8,403,186 B2 * 3/2013 Kurosawa ..... B29C 45/14836 222/566
8,695,819 B1 * 4/2014 Anderson ..... B65D 51/2835 215/6
8,701,906 B1 * 4/2014 Anderson ..... B65D 51/2835 215/227
10,065,781 B2 * 9/2018 Ichikawa ..... B65D 75/5883
2006/0201967 A1 * 9/2006 Romer ..... B65D 75/5883 222/92
2009/0008416 A1 * 1/2009 Kurosawa ..... B29C 45/14598 222/566
2010/0000960 A1 * 1/2010 Anderson ..... B65D 51/2807 215/228
2011/0240641 A1 * 10/2011 Huels ..... B29C 65/18 220/200
2012/0170876 A1 7/2012 Kuge et al.
2014/0001072 A1 * 1/2014 Christoffel ..... B65D 75/5833 206/459.5
2017/0121085 A1 * 5/2017 Ichikawa ..... B65D 75/5883

FOREIGN PATENT DOCUMENTS

JP 49-026614 7/1974
JP 56-166279 12/1981
JP 2001-097437 4/2001
JP 2001-130609 5/2001
JP 2002-205752 7/2002
JP 2002-255222 9/2002
JP 2003-312710 11/2003
JP 2007-186253 7/2007
JP 2011-148549 8/2011
WO WO 2008/027029 3/2008

OTHER PUBLICATIONS

International Search Report for PCT/JP2018/028868, dated Sep. 18, 2018.
Chinese Office Action (Application No. 201880057305.2) dated Feb. 3, 2021.

* cited by examiner

SPOUT CAP, SPOUT, AND CONTAINER WITH SPOUT

TECHNICAL FIELD

The present invention relates to a spout cap, a spout, and a container with a spout. More specifically, the present invention relates to a spout cap, a spout in which a mouth portion of a spout main body is closed by a spout cap, and a container with a spout provided with a spout.

Priority is claimed on Japanese Patent Application No. 2017-150060, filed Aug. 2, 2017, the content of which is incorporated herein by reference.

BACKGROUND

In related art, a container with a spout has been widely used as a container which contains foodstuffs such as liquid beverages, fluid foods and seasonings, and daily necessities such as liquid detergents and liquid cleansers. In general, a spout of a container with a spout is provided with a spout main body having a mouth portion functioning as a spouting port for filling contents, and a spout cap which closes the mouth portion. Since members molded from synthetic resin are widely used as the spout main body and the spout cap, in some cases, a sealing film may be provided on a distal end surface of the mouth portion of the spout main body to reliably prevent leakage of contents that may occur due to poor molding of the spout main body and the spout cap or unintended elastic deformation. Also, when contents are filled into the container with a spout, the mouth portion of the spout main body is closed, and then a retort treatment for high-temperature heating sterilization is performed, as a member that plays a role in preventing leakage of the contents due to a pressure difference between the inside and outside of the container with a spout at the time of the retort treatment, or in preventing leakage of contents due to insufficient closing of the mouth portion caused by a difference in contraction and expansion rate between the spout main body and the spout cap, it is possible to provide a sealing film on the distal end surface of the mouth portion.

However, the sealing film provided on the distal end surface of the mouth portion of the spout main body has an area equal to or slightly larger than that of the distal end surface of the mouth portion not to hinder the closing of the spout cap. Further, the sealing film is in the form of a film as its name suggests, and is very thin. Therefore, the sealing film may be difficult to be gripped and peeled off by human hands.

In addition, two operations of an operation of detaching the spout cap and an operation of peeling off the sealing film are required to open the mouth portion of the spout main body, which may be troublesome.

In connection with one of these problems, Patent Document 1 discloses a pouch container with a spout in which a knob portion of an inner seal is folded between a mouth portion of a spout main body and a screw cap. Since the inner seal is provided with an overhang portion as the knob portion, the pouch container with a spout has a structure that is easily peeled off as compared with the related art.

Further, in connection with one of these problems. Patent Document 2 discloses a structure of a seal portion capable of opening a mouth portion with an operation of closing the mouth portion of the spout main body with only the seal portion and a cover plate welded to the seal portion to peel off the seal portion. In this structure, since a separate spout cap is not provided, the mouth portion of the spout main body can be opened by one operation.

DOCUMENT OF RELATED ART

Patent Document

[Patent Document 1] Japanese Unexamined Patent Application, First Publication No. 2001-97437

[Patent Document 2] Japanese Unexamined Patent Application, First Publication No. 2001-130609

SUMMARY

Technical Problem

However, in the structure described in Patent Document 1, although the overhang portion as the knob portion is provided in the inner seal, since it is necessary to grip and peel off a film-like inner seal that is not so large with respect to a human finger in general with a finger, in some cases, it takes time to open the mouth portion of the spout main body.

In addition, two operations of detaching the screw cap and peeling off the inner seal are required to open the mouth portion of the spout main body, which may be troublesome. Furthermore, since detachment of the screw cap requires an operation of turning the cap, while one hand supports the portion having rigidity to the extent that twisting does not occur during turning, the screw cap is turned with the other hand. For this reason, in a general container with a spout, while a joining portion or the like between a bag and the spout main body rather than the bag that stores the contents, as a portion having rigidity, is supported with one hand, the screw cap is turned with the other hand. At this time, since the screw cap and the joining portion are small and a distance between the screw cap and the joining portion is short, and the force required for the turning operation of the cap is large, this is not a simple operation especially for children and elderly people with weak finger power, and an improvement therein is required.

In addition, when the mouth portion of the spout main body is opened, the peeled pieces of the inner seal are generated as trash, and there is a possibility of accidental ingestion.

In the structure described in Patent Document 2, since the thickness of the seal portion is small and the rigidity is low, in some cases, it is difficult to grip the film-like seal portion with a finger, and the operation of opening the mouth portion of the spout main body may be troublesome.

In addition, since there is a structure in which the seal portion and the cover plate are provided only on the distal end surface of the mouth portion of the spout main body, the outer peripheral surface of the mouth portion that a user puts in the mouth is in a state of being exposed to the outside, which may be unsanitary.

The present invention has been made in view of the above-described problems, and an object of the present invention is to provide a spout cap that achieves both reliable closing and easy opening of the mouth portion of the spout main body, a spout in which the mouth portion of the spout main body is closed by the spout cap, and a container with a spout provided with a spout.

Solution to Problem

A spout cap of a first aspect of the present invention is a spout cap for closing a mouth portion of a spout main body, the spout cap including: a cylindrical body portion made of resin, and a sealing film joined to the body portion, in which the sealing film has a thermal bonding layer which is configured to join to a distal end surface of the mouth portion when the mouth portion is closed.

In the first aspect of the present invention, the body portion may include a pedestal portion provided on an inner peripheral surface of the body, the sealing film may be joined to an upper surface of the pedestal portion, the pedestal portion may be provided at a position surrounding the mouth portion when the mouth portion is closed, and the upper surface of the pedestal portion may be provided to be flush with the distal end surface of the mouth portion when the mouth portion is closed.

In the first aspect of the present invention, the sealing film may have a metal layer.

In the first aspect of the present invention, the sealing film may be provided below a distal end of the body portion.

The spout cap of the first aspect of the present invention may further include a cover body disposed at a distal end of the body portion to cover the sealing film.

The spout cap of the first aspect of the present invention may further include an engaging portion which is provided on the body portion and is configured to engage with the spout main body to prevent the spout cap from detaching from the spout main body.

The spout cap of the first aspect of the present invention may further include a knob portion joined to the body portion.

In the first aspect of the present invention, the body portion may be provided with a weakened portion which breaks when the mouth portion is opened.

A spout of a second aspect of the present invention includes the spout cap of the first aspect of the present invention, and a spout main body having a mouth portion, in which the body portion of the spout cap and the mouth portion of the spout main body are joined by the sealing film.

A container with spout of a third aspect of the present invention includes the spout of the second aspect of the present invention, and a container main body which is filled with contents, in which the spout and the container main body are thermally joined.

Effects

According to the present invention, it is possible to provide a spout cap that achieves both reliable closing and easy opening of the mouth portion of the spout main body, a spout in which the mouth portion of the spout main body is closed by the spout cap, and a container with a spout provided with a spout.

DESCRIPTION OF EMBODIMENTS

A spout cap and a spout according to an embodiment of the present invention will be described with reference to FIGS. 1 to 5.

Figure 1:
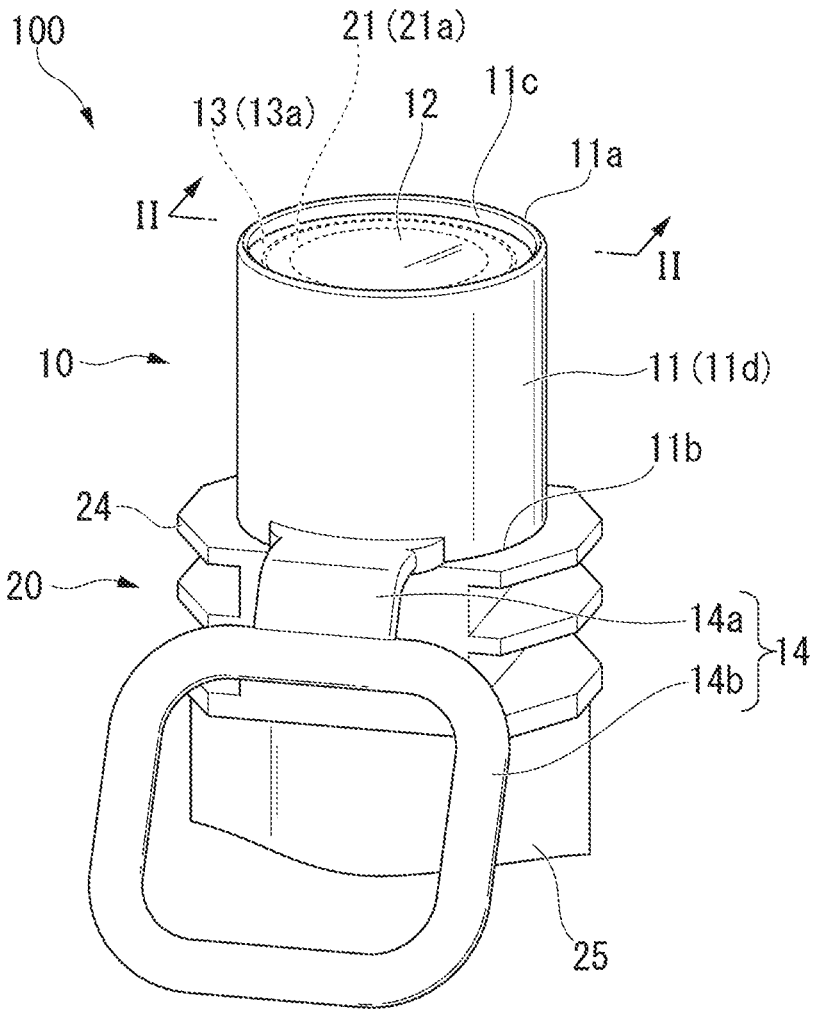
FIG. 1 is a perspective view showing a spout according to an embodiment of the present invention.
Figure 2:
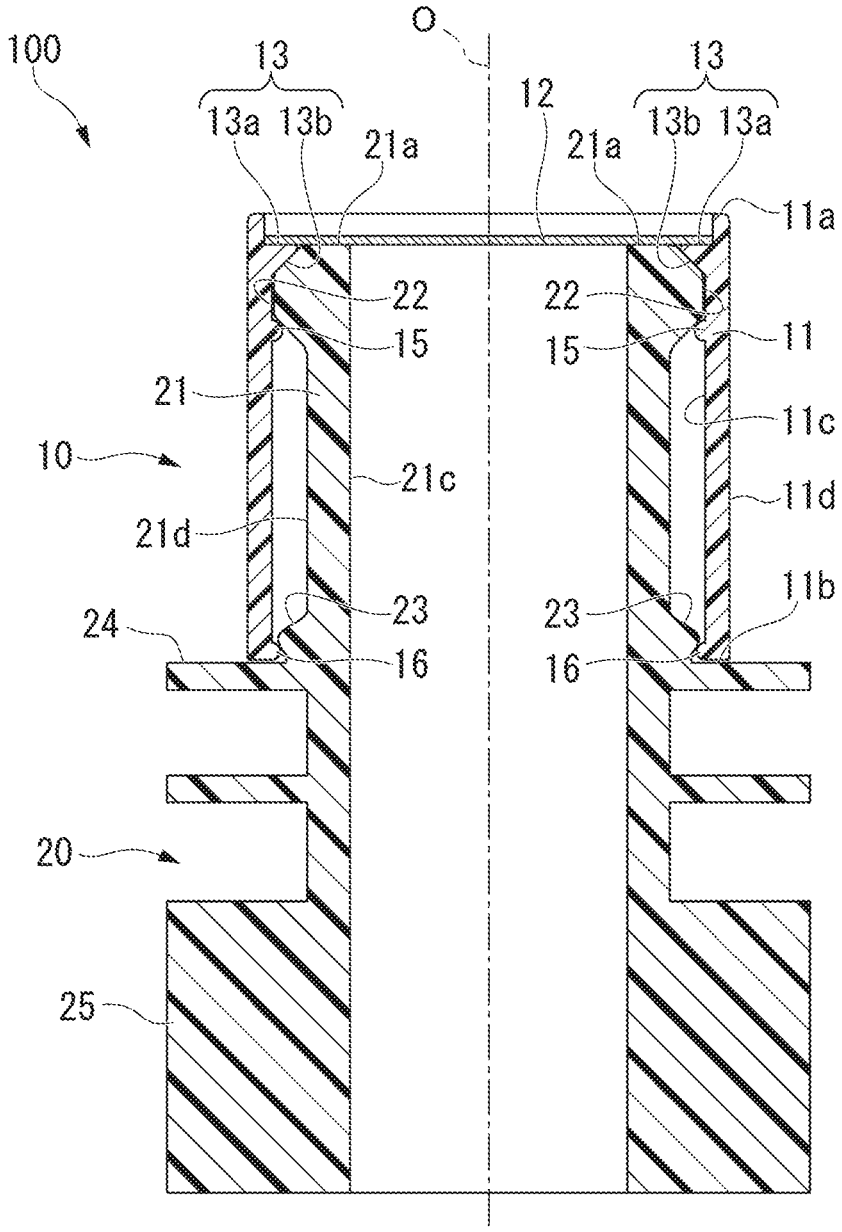
FIG. 2 is a cross-sectional view of the spout shown in FIG. 1 taken along a line II-II.
Figure 3:
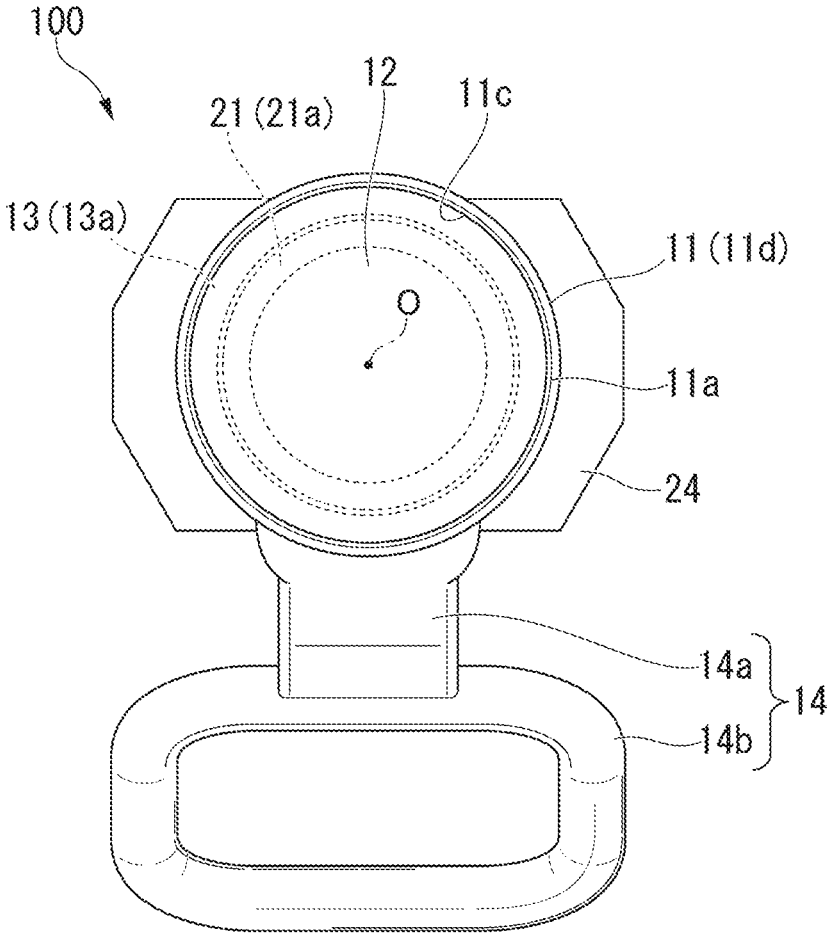
FIG. 3 is a plan view of the spout shown in FIG. 1.

FIG. 1 is a perspective view showing a spout 100 of the present embodiment. FIG. 2 is across-sectional view of the spout 100 taken along a line II-II. FIG. 3 is a plan view of the spout 100.

As shown in FIGS. 1 to 3, the spout 100 is provided with a spout main body 20 functioning as a spouting port for contents filled into a container, and a spout cap 10 attached to the spout main body 20.

In the following description, a side on which the spout cap 10 is provided is referred to as a distal end side (or an upper side) of the spout 100, and a side on which the spout main body 20 is provided is referred to as a proximal end side (or a lower side) of the spout 100.

(Spout Cap)

The spout cap 10 is provided with a cylindrical body portion 11 and a sealing film 12 joined to the body portion 11.

Although the body portion 11 of the present embodiment has a circular shape in a plan view, that is, a rounded cylindrical shape (see FIG. 3), the shape is not limited thereto, and may be, for example, a rectangular or polygonal shape in a plan view. A direction along a central axis O of the body portion 11 may be referred to as an axial direction, and a direction intersecting the central axis O may be referred to as a radial direction.

The body portion 11 includes a distal end 11*a* located on a distal end side of the spout 100, a proximal end 11*b* located on a proximal end side of the spout 100, an inner peripheral surface 11 of a side wall which connects the distal end 11*a* and the proximal end 11*b*, and an outer peripheral surface 11*d* of the side wall which connects the distal end 11*a* and the proximal end 11*b*.

A material of the body portion 11 can be, for example, a synthetic resin. Examples of the synthetic resin include, for example, polyolefin resin, polyamide resin, polyester resin, (meth) acrylic resin, vinyl chloride resin, vinylidene chloride resin, polyether sulfone, ethylene-vinyl alcohol copolymer and the like. Above all, it is possible to adopt polyolefin resin in consideration of excellent workability and low cost. Examples of polyolefin resins include, for example, polyethylene-based resins such as high-density polyethylene, medium-density polyethylene, high-pressure low-density polyethylene, linear low-density polyethylene and ethylene-vinyl acetate copolymer, olefin-based elastomers such as ethylene-α-olefin copolymer, polypropylene-based resins such as polypropylene, ethylene-propylene random copolymer and α-olefin-propylene random copolymer, cyclic polyolefin resins and the like. These resins may be blended for improving performance, or may be partially cross-linked for the purpose of improving heat resistance. When the body portion 11 is subjected to a retort treatment for high-temperature heating sterilization, polypropylene having excellent heat resistance can be used.

The body portion 11 may be formed of a single material, or may have a multilayer structure including various resin layers.

The body portion 11 can be formed by a known molding method such as injection molding or compression molding.

Figure 4:
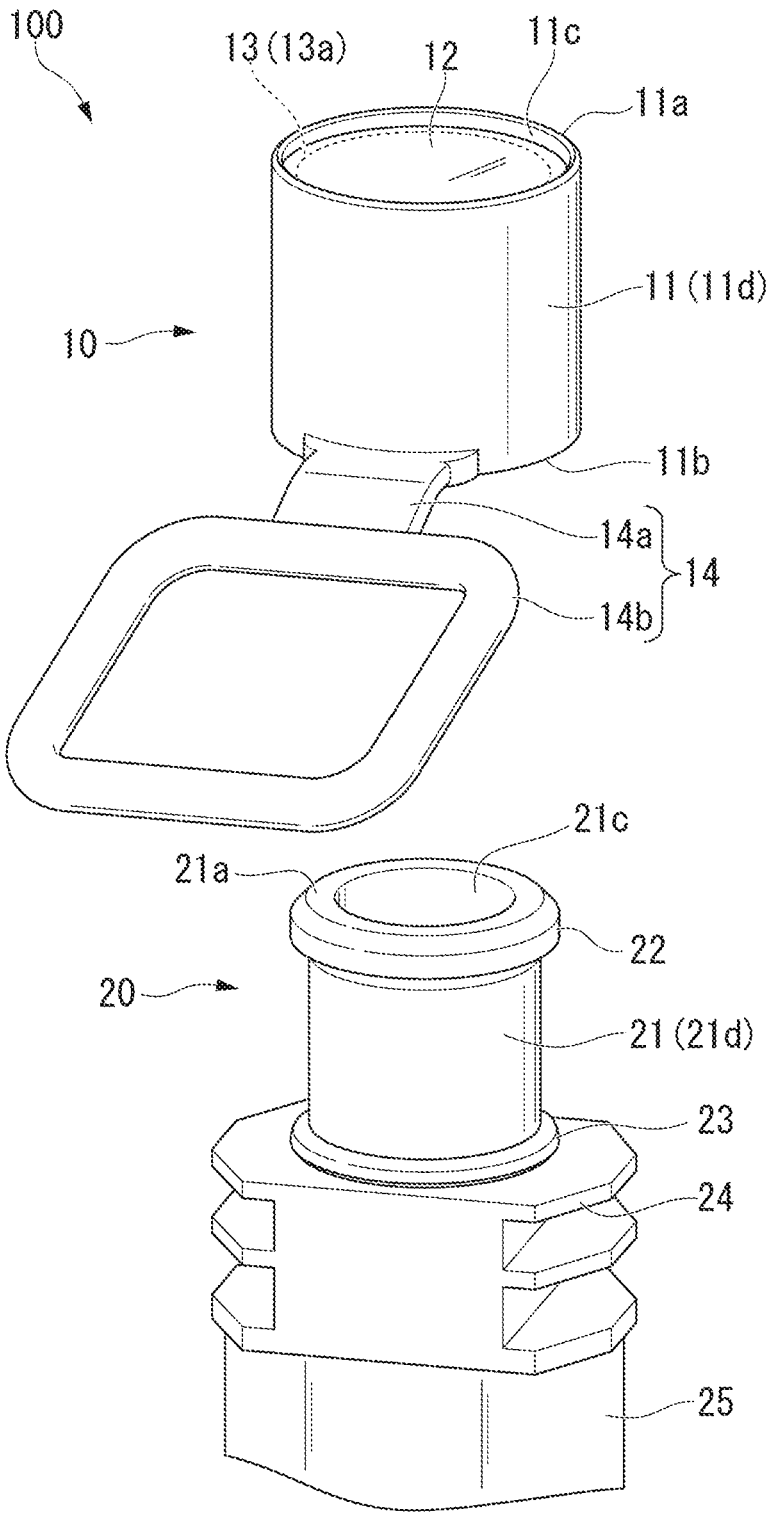
FIG. 4 is an explanatory view showing a configuration of the spout according to the embodiment of the present invention.
Figure 5:
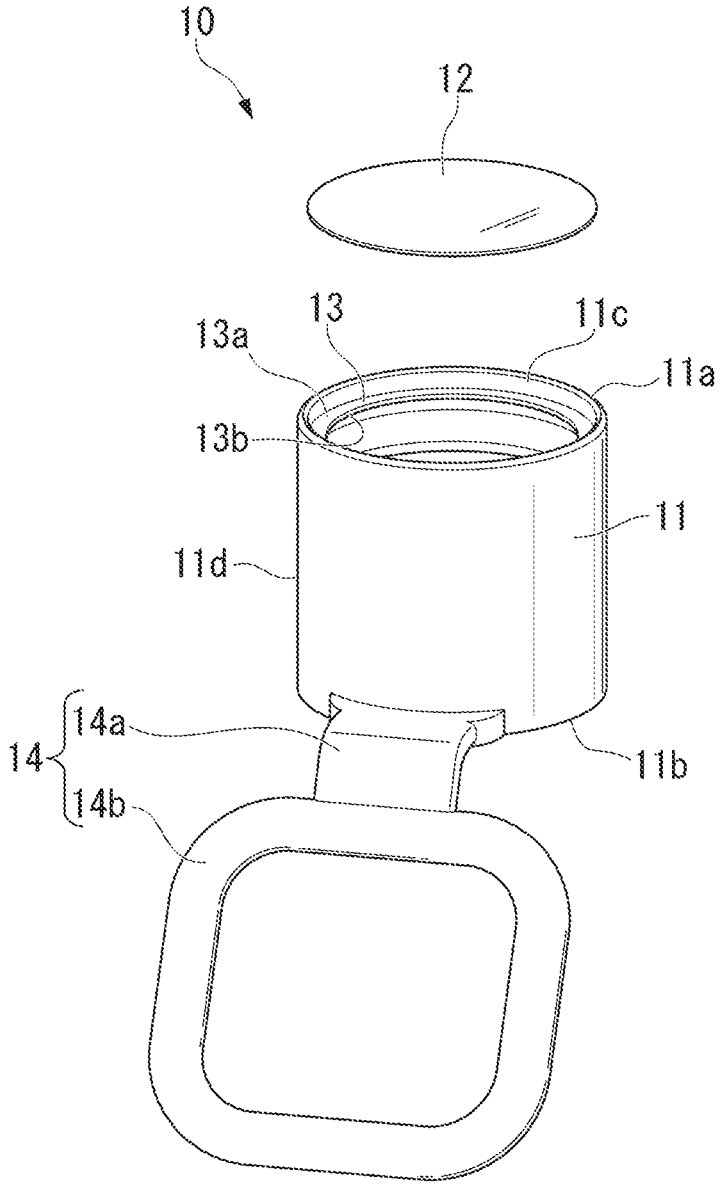
FIG. 5 is an explanatory view showing a configuration of a spout cap according to the embodiment of the present invention.

FIG. 4 is a diagram showing a state in which the spout cap 10 and the spout main body 20 are separated. FIG. 5 is a diagram showing a state in which the body portion 11 and the sealing film 12 are separated from each other in the spout cap 10.

As shown in FIGS. 4 and 5, the body portion 11 includes a pedestal portion 13 that is continuously connected to the inner peripheral surface 11*c* at a position closer to the distal end 11*a* than to the proximal end 11*b* (above the body portion 11). The sealing film 12 is joined to the upper surface 13*a* of the pedestal portion 13. The body portion 11 and the sealing film 12 are joined on the upper surface 13*a* of the pedestal portion 13. The pedestal portion 13 has an annular shape in a plan view (see FIG. 3).

As shown in FIG. 2, the pedestal portion 13 includes an upper surface 13*a* and a lower surface 13*b*. The upper surface 13*a* of the present embodiment is disposed to be parallel to a plane perpendicular to the central axis O of the body portion 11. In addition, the upper surface 13*a* may be slightly inclined upward toward the radially inner side, or may be slightly inclined downward toward the radially inner side. The lower surface 13*b* is inclined toward the upper surface 13*a* (upward) toward the radially inner side. That is, in FIG. 2 which is a cross-sectional view including the central axis O, the pedestal portion 13 has a tapered shape in which the thickness in a vertical direction (an axial direction) decreases toward the radially inner side. The lower surface 13*b* formed to be inclined is provided to be in contact with a mouth portion 21 of a spout main body 20, which will be described below.

Also, as shown in FIG. 3, the pedestal portion 13 is provided in the body portion 11 in an annular shape. The pedestal portion 13 protrudes radially inward from the inner peripheral surface 11*c* of the body portion 11 and is consecutively provided in the circumferential direction of the body portion 11.

The arrangement and shape of the pedestal portion 13 may be appropriately determined in relation to the mouth portion 21 of the spout main body 20 to be described below. For example, the pedestal portion 13 may be provided on a side closer to the proximal end 11*b*, or may be provided discontinuously in the circumferential direction of the body portion 11. Further, the lower surface 13*b* of the pedestal portion 13 may not be provided to be inclined, and may be provided to be parallel to the upper surface 13*a*. The pedestal portion 13 can be formed simultaneously with the molding of the body portion 11.

A film that can be thermally joined to the upper surface 13*a* of the pedestal portion 13 provided on the body portion 11 is used as the sealing film 12. In addition, a film that can also be thermally joined to the mouth portion 21 of the spout main body 20 described below is used. The sealing film 12 is made of a film material, and can be a laminated film in which at least a base material layer and a thermal bonding layer are laminated, and a surface joined to the upper surface 13*a* of the pedestal portion 13 is a thermal bonding layer.

As the base material layer, it is possible to use a film having excellent printability and having piercing strength, tensile strength, impact resistance and the like. Examples of the material of the base material layer include, for example, polyethylene terephthalate, polypropylene, polyamide, and ethylene vinyl alcohol copolymer, and the like, and a biaxially stretched film or a uniaxially stretched film thereof can be used. In addition, a vapor-deposited film obtained by vapor-depositing a metal such as aluminum and magnesium or an oxide such as silicon oxide, a coat film coated with a barrier coating agent such as polyvinylidene chloride or the like may be used to impart a barrier property against oxygen, water vapor and light such as ultraviolet light to these films. The base material layer may be a single unit or a laminate of the above-described films.

The thermal bonding layer is a layer that can be heated and melted within a temperature range capable of maintaining the shape of the base material layer, and is configured to be thermally joined. Examples of the material of the resin for the thermal bonding layer include, for example, polyethylene such as high-density polyethylene, low-density polyethylene and linear low-density polyethylene, polypropylene and the like, and the thermal bonding layer can be a film in which the unstretched films and the aforementioned resins are extruded in layers. When the spout cap is exposed to a retort treatment for performing the high-temperature heating sterilization, among these resins, polypropylene having heat resistance to the high-temperature heating sterilization may be used.

The laminated film of the sealing film 12 may have an intermediate layer between the base material layer and the thermal bonding layer, if necessary. Examples of the intermediate layer include, for example, films having functionalities such as oxygen barrier properties, water vapor barrier properties, and tearability. Specific examples of the intermediate layer include, for example, a metal layer such as aluminum, the aforementioned vapor-deposited film, and a coat film.

The laminated film made up of the base material layer, the thermal bonding layer, and the intermediate layer used as necessary can be manufactured by a known method such as a dry lamination method using an adhesive and an extrusion lamination method using a heat-adhesive resin.

Further, the sealing film 12 may be a single-layer film made of a thermally bondable film.

The sealing film 12 of the present embodiment has a circular shape in a plan view (see FIG. 3). If the shape of the body portion 11 in a plan view is other than a circular shape, the shape of the sealing film may also be the same according to the shape. The sealing film 12 of the present embodiment is disposed to close the upper end opening of the body portion 11, while intersecting the central axis O of the body portion 11 or to partition the internal space of the body portion 11 vertically.

The joining between the body portion 11 and the sealing film 12 can be performed simultaneously with the injection molding of the body portion 11, by a method such as an insert injection performed after disposing the sealing film 12 in a metal mold. Further, after the body portion 11 and the sealing film 12 are molded, the body portion 11 and the sealing film 12 can be joined by a method such as a high-frequency seal, an ultrasonic seal, an impulse seal and a hot plate seal. More specifically, the thermal bonding layer of the sealing film 12 and the upper surface 13*a* of the pedestal portion 13 provided on the body portion 11 can be thermally welded and joined.

An outer peripheral edge part of the lower surface, which is a surface of the thermal bonding layer of the sealing film 12, is joined to the upper surface 13*a* of the pedestal portion 13. A portion of the thermal bonding layer of the sealing film 12 radially inward from the outer peripheral edge part joined to the upper surface 13*a* of the pedestal portion 13 faces downward, that is, faces the internal space of the body portion 11 into which the mouth portion 21 of the spout main body 20 to be described below is inserted.

As shown in FIG. 2, the body portion 11 includes a first convex portion 15 (an engaging portion) provided on the inner peripheral surface 11*c* at a position closer to the distal end 11*a* than to the proximal end 11*b* (above the body portion 11). Further, the body portion 11 includes a second convex portion 16 (an engaging portion) provided on the inner peripheral surface 11*c* at a position closer to the proximal end 11*b* than to the distal end 11*a* (below the body portion 11). The first convex portion 15 and the second convex portion 16 are consecutively provided in the circumferential direction of the body portion 11, respectively. The first convex portion 15 and the second convex portion 16 are configured to be able to engage with convex portions (a first convex portion 22 and a second convex portion 23) provided on the spout main body 20 to be described below. That is, the first convex portion 15 and the second convex portion 16 are configured to be able to engage to or detachable from the first convex portion 22 and the second convex portion 23 provided on the spout main body 20 by elastically deforming the body portion 11 when the spout cap 10 is attached to or detached from the spout main body 20. The spout cap 10 is attached to the spout main body 20 so as not to easily detach from the spout main body 20 due to the engagement.

The arrangement and shape of the first convex portion 15 and the second convex portion 16 may be determined as appropriate in relation to the convex portions (the first convex portion 22 and the second convex portion 23) provided on the spout main body 20 to be described below. For example, the convex portions may be provided discontinuously in the circumferential direction of the body portion 11, or may be provided only in one of the first convex portion 15 and the second convex portion 16. When the first convex portion 15 and the second convex portion 16 are provided discontinuously, a discontinuous portion can function as a groove for a loophole of water that remains in a gap between the spout cap 10 and the mouth portion 21 of the spout main body 20 at the time of the retort treatment.

The body portion 11 includes a knob portion 14 that is consecutively connected to the outer peripheral surface 11*d* at a position closer to the proximal end 11*b* than the distal end 11*a* (below the body portion 11). The knob portion 14 has a belt portion 14*a* which is consecutively provided on the outer peripheral surface 11*d* of the body portion 11 and protrudes in a direction away from the body portion 11, and an overhang portion 14*b* which has a rounded square shape consecutively provided in the belt portion 14*a* and has a penetration hole at a central part. A user can easily detach the spout cap 10 by gripping and lifting the overhang portion 14*b* with a finger when opening the mouth portion 21 of the spout main body 20, which will be described below.

The overhang portion 14*b* is not limited to the above, and may be a member having a substantially circular shape with a penetration hole at the central part or a member having no penetration hole at the central part. Instead of providing the overhang portion 14*b*, the knob portion 14 can be configured only with the belt portion 14*a*. In this case, when opening the mouth portion 21 of the spout main body 20, the user can easily detach the easily spout cap 10, by gripping and lifting the belt portion 14*a* with a finger, or by pushing the belt portion 14*a* upward with a thumb or the like without gripping. The knob portion 14 can be formed simultaneously with molding of the body portion 11.

Whether to provide the knob portion 14 may be appropriately determined in consideration of the user of the spout 100 or the situation in which the spout 100 is used, and the spout 100 may not include the knob portion 14.

(Spout Main Body)

The spout main body 20 is provided with a cylindrical mouth portion 21, a flange portion 24, and a container attachment portion 25. As shown in FIG. 2, the proximal end of the mouth portion 21 and the distal end of the flange portion 24 are consecutively provided, and the proximal end of the flange portion 24 and the distal end of the container attachment portion 25 are consecutively provided. The spout main body 20 is configured integrally with the mouth portion 21, the flange portion 24, and the container attachment portion 25.

The mouth portion 21 is provided with a distal end surface 21*a* located on the distal end side of the spout 100, an inner peripheral surface 21*c* of a side wall connecting the distal end surface 21*a* and the flange portion 24, and an outer peripheral surface 21*d* of the side wall connecting the distal end surface 21*a* and the flange portion 24.

As shown in FIG. 2, the mouth portion 21 includes a first convex portion 22 on the outer peripheral surface 21*d* at a position closer to the distal end surface 21*a* than the flange portion 24 (above the mouth portion 21). More specifically, the first convex portion 22 is formed to have a configuration which can be engaged with the first convex portion 15 provided on the body portion 11 of the spout cap 10. The upper surface of the first convex portion 22 is inclined downward toward the outside in the radial direction, and the lower surface of the first convex portion 22 is inclined upward toward the outside in the radial direction. Further, the mouth portion 21 includes a second convex portion 23 on the outer peripheral surface 21*d* at a position closer to the flange portion 24 than the distal end surface 21*a* (below the mouth portion 21). More specifically, the second convex portion 23 is formed to have a configuration that can be engaged with the second convex portion 16 provided on the body portion 11 of the spout cap 10. The first convex portion 22 and the second convex portion 23 are continuously provided in the circumferential direction of the mouth portion 21, respectively. By the engagement between the first convex portion 22 and the first convex portion 15 and the engagement between the second convex portion 23 and the second convex portion 16, the spout cap 10 is attached to the spout main body 20 without detaching therefrom.

Further, the arrangement and shape of the first convex portion 22 and the second convex portion 23 may be determined as appropriate in relation to the first convex portion 15 and the second convex portion 16. For example, the first convex portion 22 and the second convex portion 23 may be provided discontinuously in the circumferential direction of the mouth portion 21, or only one of the first convex portion 22 and the second convex portion 23 may be provided. When the first convex portion 22 and the second convex portion 23 are provided discontinuously, the discontinuous portion can function as a groove for a loophole of water which remains in the gap between the spout cap 10 and the mouth portion 21 of the spout main body 20 at the time of the retort treatment.

A distal end of the flange portion 24 is consecutively connected to a proximal end of the mouth portion 21. The flange portion 24 can be used for positioning the spout 100 with respect to the container main body 101 when attaching the spout 100 to the container main body 101, like a container 500 with spout shown in FIG. 9.

Further, in the mass production process, a large amount of the spout main body 20, spout 100, or container 500 with spout can be smoothly conveyed and supplied by hooking the flange portion 24 on a conveyance mechanism such as a rail.

A distal end of the container attachment portion 25 is consecutively connected to a proximal end of the flange portion 24. The container attachment portion 25 is a portion that is fixed to the container main body 101 without any gap by thermal bonding, when the spout 100 is attached to the container main body 101, like the container 500 with spout shown in FIG. 9.

The material of the spout main body 20 can be the same as the material used for the body portion 11 of the spout cap 10, and can be formed by a known molding method such as injection molding or compression molding. When the contents are foodstuffs, etc., the material of the spout main body 20 can adopt medium-density polyethylene, high-density polyethylene, linear low-density polyethylene, and polypropylene considering that the spout main body 20 is hard to break when eating and drinking and has little effect on a living body even if it enters the living body. Further, high-density polyethylene and polypropylene can be adopted in consideration of low gas permeability. Further, in order to further reduce gas permeability, it is also possible to provide the spout main body 20 which includes a barrier material such as a vinylidene chloride resin, an ethylene-vinyl alcohol copolymer, a vapor deposition film or a metal foil such as an aluminum foil inside the spout main body 20.

(Spout)

As shown in FIGS. 1 to 3, the spout 100 according to the present embodiment is configured by attaching the spout cap 10 to the spout main body 20.

The spout cap 10 is attached to the spout main body 20 such that the outer peripheral surface 21*d* of the mouth portion 21 of the spout main body 20 is covered with the body portion 11 of the spout cap 10.

Since the outer peripheral surface 21*d* of the mouth portion 21 of the spout main body 20 is covered with the body portion 11 of the spout cap 10, the outer peripheral surface 21*d* of the mouth portion 21 is not exposed to the outside until the mouth portion 21 is opened. Therefore, the spout 100 can be provided as a product excellent in hygiene.

As shown in FIGS. 1 to 3, the closing of the mouth portion 21 of the spout main body 20 by the spout cap 10 is performed by joining the sealing film 12, which is joined to the body portion 11 of the spout cap 10, also to the mouth portion 21 of the spout main body 20.

As shown in FIG. 2, when closing the mouth portion 21 of the spout main body 20 by the spout cap 10, by the engagement between the first convex portion 22 and the first convex portion 15 and the engagement between the second convex portion 23 and the second convex portion 16, the spout cap 10 is attached to the spout main body 20 without detaching therefrom.

Further, the configuration for preventing the spout cap 10 from detaching from the spout main body 20 is not limited to the configuration as shown in FIG. 2, and may be configured by, for example, a concave portion (an engaging portion) provided in the spout cap 10 and a convex portion (an engaged portion) provided in the spout main body 20.

Further, since the obliquely provided lower surface 13*b* of the pedestal portion 13 is in contact with the inclined surface (the upper surface) of the first convex portion 22 of the mouth portion 21, and the proximal end 11*b* of the body portion 11 is in contact with the position of the distal end of the flange portion 24, positioning of the spout cap 10 and the mouth portion 21 of the spout main body 20 is facilitated.

As shown in FIGS. 2 and 3, in a state in which the spout cap 10 is attached to the spout main body 20, the pedestal portion 13 provided on the body portion 11 is provided to surround the mouth portion 21 of the spout main body 20, and the upper surface 13*a* of the pedestal portion 13 is provided to be flush with the distal end surface 21*a* of the mouth portion 21.

When the spout cap 10 is attached to the spout main body 20 (when the mouth portion 21 of the spout main body 20 is closed by the spout cap 10), since the pedestal portion 13 of the spout cap 10 is provided to surround the mouth portion 21, and the upper surface 13*a* of the portion 13 is provided to be flush with the distal end surface 21*a* of the mouth portion 21, the sealing film 12 provided in the spout cap 10 can also be joined to the distal end surface 21*a* of the mouth portion 21 of the spout main body 20. That is, the pedestal portion 13 is provided at a position surrounding the mouth portion 21 when the mouth portion 21 is closed. The joining between the sealing film 12 and the distal end surface 21*a* of the mouth portion 21 is performed via a thermal bonding layer of the sealing film 12, and a method such as a high-frequency sea, an ultrasonic seal, an impulse seal, and a hot plate seal can be used.

In this way, since the sealing film 12 joined to the body portion 11 of the spout cap 10 is also joined to the mouth portion 21 of the spout main body 20, the mouth portion 21 of the spout main body 20 is reliably closed.

Here, the expression "the upper surface 13*a* of the pedestal portion 13 is provided to be flush with the distal end surface 21*a* of the mouth portion 21" means that the heights of the upper surface 13*a* and the distal end surface 21*a* are equivalent to such an extent that the sealing film 12 joined to the upper surface 13*a* of the pedestal portion 13 can also come into contact with the distal end surface 21*a* of the mouth portion 21. The expression is not limited to a case in which the upper surface 13*a* and the distal end surface 21*a* are completely flush with each other, and does not exclude an existence of a slight displacement (step) between the distal end 13*a* and the distal end surface 21*a*.

In particular, in a case in which the distal end surface 21*a* of the mouth portion 21 is slightly higher than (above) the upper surface 13*a* of the pedestal portion 13, when the spout cap 10 is attached to the spout main body 20, the distal end surface 21*a* can be reliably brought into contact with the sealing film 12. More specifically, the height of the distal end surface 21*a* of the mouth portion 21 may be higher than the upper surface 13*a* of the pedestal portion 13 within a range of 1 mm or less.

As shown in FIGS. 1 and 2, the sealing film 12 provided in the spout cap 10 is provided below the distal end 11*a* of the body portion 11. That is, the pedestal portion 13 to which the sealing film 12 is joined is provided to be located on a side closer to the proximal end 11*b* (below) than the distal end 11*a*.

Figure 9:
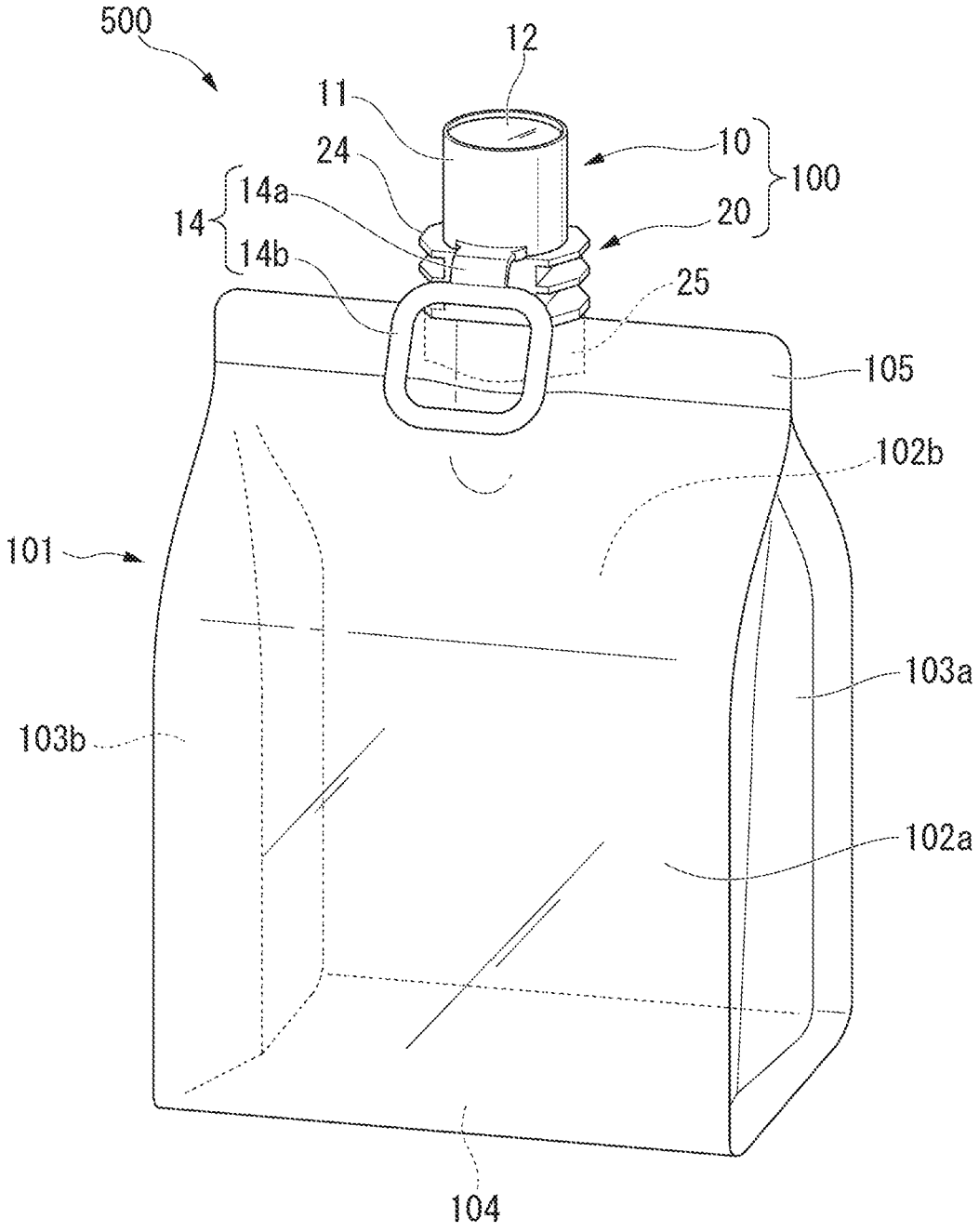
FIG. 9 is a perspective view showing a container with a spout according to the embodiment of the present invention.

With such a configuration, since it is possible to provide a fixed distance between the distal end 11*a* of the body portion 11 and the sealing film 12, when the user carries the container 500 with spout to which the spout 100 as shown in FIG. 9 is attached, it is possible to reduce a situation in which an object unintentionally comes into contact with the sealing film 12 and breaks.

Next, a procedure for manufacturing the spout 100 configured as described above will be described.

The spout cap 10 is manufactured according to the procedure described above. That is, after the manufactured sealing film 12 is disposed in the metal mold, the body portion 11 is molded by insert injection to manufacture the spout cap 10, or after the body portion 11 and the sealing film 12 are formed, by joining the body portion 11 and the sealing film 12 using a method such as a high-frequency seal, an ultrasonic seal, an impulse seal, and a hot plate seal, the spout cap 10 is manufactured. Further, the spout main body 20 is also separately manufactured by injection molding or the like.

Next, the spout cap 10 is attached to the spout main body 20 such that the body portion 11 covers the outer peripheral surface 21*d* of the mouth portion 21, while elastically deforming the body portion 11 of the spout cap 10. At this time, the first convex portion 15 and the second convex portion 16 of the body portion 11 engage with the first convex portion 22 and the second convex portion 23 provided on the spout main body 20, respectively. Further, in the present embodiment, the first convex portion 22 is sandwiched between the pedestal portion 13 and the first convex portion 15 that are adjacent to each other in the vertical direction (the axial direction). As a result, the upper surface 13*a* of the pedestal portion 13 and the distal end surface 21*a* (the upper surface) of the mouth portion 21 are flush with each other.

Subsequently, the thermal bonding layer (the radially inner portion of the outer peripheral edge part) of the sealing film 12 is joined to the distal end surface 21*a* of the mouth portion 21 by a method such as a high-frequency seal, an ultrasonic seal, an impulse seal, and a hot plate seal, the body portion 11 of the spout cap 10 and the mouth portion 21 of the spout main body 20 are joined by the sealing film 12, and the manufacturing of the spout 100 is completed.

Further, the body portion 11, the sealing film 12, and the spout main body 20 are individually manufactured, and after the body portion 11 is attached to the mouth portion 21 of the spout main body 20, by collectively joining the sealing film 12 to the upper surface 13*a* of the pedestal portion 13 and the distal end surface 21*a* (the upper surface) of the mouth portion 21, using the method such as a high-frequency seal, an ultrasonic seal, an impulse seal and a hot plate seal, the spout 100 may be manufactured.

Next, the opening operation of the mouth portion 21 of the spout main body 20 in the spout 100 configured as described above will be described.

A user lifts the body portion 11, by gripping the overhang portion 14*b* of the knob portion 14 of the spout cap 10 with a finger and lifting the knob portion 14. By one operation, the engagement between the second convex portion 16 and the second convex portion 23 shown in FIG. 2 is released, and the first convex portion 15 moves upward continuously or almost simultaneously to get over the first convex portion 15 or the first convex portion 22. As a result, the spout cap 10 is detached from the spout main body 20.

Further, in a case in which the knob portion 14 is not provided, the user may lift the body portion 11 by gripping the outer peripheral surface 11*d* of the body portion 11 of the spout cap 10 with a finger.

When the spout cap 10 is lifted and detached from the spout main body 20, since the sealing film 12 joined to the upper surface 13*a* of the pedestal portion 13 is also lifted together with the body portion 11, the sealing film 12 is peeled off from the distal end surface 21*a* of the mouth portion 21 of the spout main body 20.

In this manner, the user can open the mouth portion 21 of the spout main body 20 in the spout 100 by only one operation of lifting the spout cap 10.

Even when the sealing film 12 is peeled off from the distal end surface 21*a* of the mouth portion 21, the joining between the sealing film 12 and the upper surface 13*a* of the pedestal portion 13 of the body portion 11 is maintained, for example, as shown in FIG. 4. As a result, the sealing film 12 peeled off from the distal end surface 21*a* of the mouth portion 21 does not become a peeled piece, but remains joined to the pedestal portion 13 of the spout cap 10.

While maintaining the joining between the sealing film 12 and the upper surface 13*a* of the pedestal portion 13 of the body portion 11, the sealing film 12 is more firmly joined to the upper surface 13*a* than the distal end surface 21*a* so that the sealing film 12 is peeled off from the distal end surface 21*a* of the mouth portion 21. As a specific method for providing such a difference in bonding strength, for example, it is possible to adopt various methods such as a method of setting a joining area between the sealing film 12 and the upper surface 13*a* to be wider than a joining area between the sealing film 12 and the distal end surface 21*a*, a method of changing conditions for joining the sealing film 12, a method of making a material of the upper surface 3*a* different from a material of the distal end surface 21*a*, and a method of performing different surface treatments on the upper surface 13*a* and the distal end surface 21*a*. Among these methods, according to the method of setting the joining area between the sealing film 12 and the upper surface 13*a* to be wider than the joining area between the sealing film 12 and the distal end surface 21*a*, the manufacturing process of the spout 100 can be simplified.

Further, as long as the sealing film 12 can be peeled off from the distal end surface 21*a* of the mouth portion 21, while maintaining the joining between the sealing film 12 and the upper surface 13*a* of the pedestal portion 13 of the body portion 11, the method is not limited to the above-described methods and any method may be used.

As described above, in the spout cap 10 and the spout 100 of the present embodiment, the sealing film 12 of the spout cap 10 can also thermally join to the distal end surface 21*a* of the mouth portion 21 of the spout main body 20, so that the mouth portion 21 can be reliably closed.

When the mouth portion 21 is opened, since the sealing film 12 can be peeled from the distal end surface 21*a* of the mouth portion 21 by lifting the spout cap 10, there is no need for an operation of gripping and peeling off the sealing film 12 with a finger.

Further, since the sealing film 12 of the spout cap 10 can also thermally join to the distal end surface 21*a* of the mouth portion 21 of the spout main body 20, the mouth portion 21 can be opened by one operation of lifting the spout cap 10.

Further, when the mouth portion 21 is opened, since the sealing film 12 peeled off from the distal end surface 21*a* of the mouth portion 21 is continuously joined to the pedestal portion 13 of the spout cap 10, there is no generation of peeled pieces that become dust.

Therefore, according to the spout cap 10 and the spout 100 of the present embodiment, it is possible to achieve both reliable closing and easy opening of the mouth portion 21 of the spout main body 20.

Further, the spout cap 10 is not a screw type, but is attached to the spout main body 20, by joining between the sealing film 12 joined to the body portion 11 of the spout cap 10 and the mouth portion 21 of the spout main body 20, engagement between the first convex portion 22 and the first convex portion 15, and engagement between the second convex portion 23 and the second convex portion 16. For this reason, first, the engagement is released by the elastic deformation of the spout cap 10, and thereafter (or almost simultaneously), the joined sealing film 12 is peeled off from the mouth portion 21, and the spout cap 10 is detached from the spout main body 20. As a result, when opening the mouth portion 21, there is no need for a large force accompanied by a turning operation of the screw cap. Further, the spout cap 10 does not easily detach from the spout main body 20 by the engagement between the first convex portion 22 and the first convex portion 15 and the engagement between the second convex portion 23 and the second convex portion 16.

Therefore, according to the spout cap 10 and the spout 100 of the present embodiment, the mouth portion 21 of the spout main body 20 can be easily opened.

Next, a modified example of the spout 100 will be described. In the following description, the same components as those already described are denoted by the same reference numerals, and repeated description will not be provided.

First Modified Example

Figure 6:
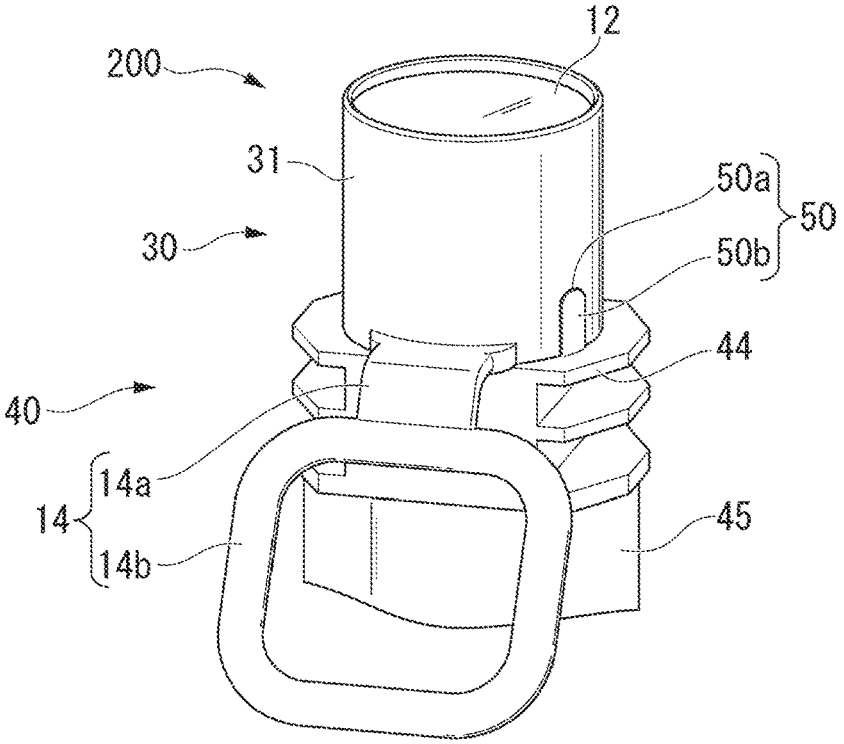
FIG. 6 is a perspective view showing a spout according to a first modified example of the embodiment of the present invention.

FIG. 6 is a perspective view showing a spout 200 according to a first modified example of the present embodiment. As shown in FIG. 6, the spout 200 includes a spout main body 40 and a spout cap 30 attached to the spout main body 40. The spout 200 includes a turning prevention mechanism 50 which prevents the spout cap 30 and the spout main body 40 from turning relative to each other. Other configurations are the same as those of the above-described spout 100.

The turning prevention mechanism 50 includes a turning prevention concave portion 50*a* provided on the proximal end side of the body portion 31 of the spout cap 30, and a turning prevention convex portion 50*b* provided to stand upright on the distal end side of the flange portion 44 of the spout main body 40. In the spout main body 40, a container attachment portion 45 is provided on the proximal end side of the flange portion 44.

As shown in FIG. 6, the turning prevention concave portion 50*a* is provided to notch a part of the proximal end side of the body portion 31, and the turning prevention convex portion 50*b* fitted to the turning prevention concave portion 50*a* is provided on the distal end side of the flange portion 44.

When the spout cap 30 tries to turn in the circumferential direction of the body portion 31, since the turning prevention concave portion 50*a* and the turning prevention convex portion 50*b* are fitted, the turning prevention convex portion 50*b* becomes an obstacle and the spout cap 30 cannot turn.

Since the spout cap 30 and the spout main body 40 can be prevented from turning relative to each other by providing the turning prevention mechanism 50 in this way, the spout cap 30 can be prevented from turning by an unexpected impact, or at the time of detachment of the spout cap 30, the spout cap 30 can be prevented from wobbling in the circumferential direction of the body portion 31.

Further, the turning prevention concave portion 50*a* and the turning prevention convex portion 50*b* can also be used for positioning when the spout cap 30 is attached to the spout main body 40.

Furthermore, the spout cap 30 and the spout 200 of the first modified example have the same effects as the spout cap 10 and the spout 100 described above.

The configuration of the turning prevention mechanism is not limited to the aforementioned configuration, and can take various forms. For example, the configuration of the turning prevention mechanism may be provided such that the convex portion provided on the spout cap 30 and the convex portion provided on the spout main body 40 are engaged in the circumferential direction of the body portion 31.

Further, the spout cap 30 and the spout main body 40 may be prevented from turning relative to each other, by setting the shapes of the body portion 31 of the spout cap 30 and the mouth portion of the spout main body 40 to a square shape.

Further, by providing a configuration in which the knob portion 14 including the belt portion 14*a* and the overhang portion 14*b* is hooked on a part of the spout main body 40 such as the flange portion 44, the spout cap 30 and the spout main body 40 may be prevented from turning relative to each other.

Second Modified Example

Figure 7:
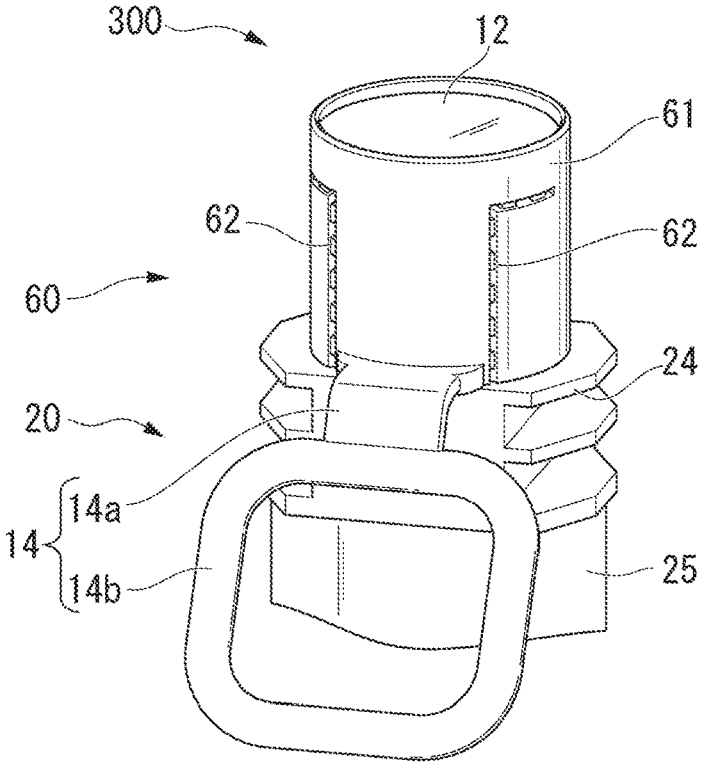
FIG. 7 is a perspective view showing a spout according to a second modified example of the embodiment of the present invention.

FIG. 7 is a perspective view showing a spout 300 according to a second modified example of the present embodiment. As shown in FIG. 7, the spout 300 is provided with a spout main body 20, and a spout cap 60 attached to the spout main body 20. The spout cap 60 of the spout 300 is provided with a weakened portion 62 that breaks when the spout cap 60 is detached from the spout main body 20. Other configurations are the same as those of the above-described spout 100.

The weakened portion 62 is provided on a body portion 61. As shown in FIG. 7, the weakened portions 62 are provided on both sides with the knob portion 14 sandwiched therebetween, respectively.

Each weakened portion 62 is provided to start from the proximal end of the body portion 61, proceed linearly toward the distal end of the body portion 61, and proceed in the circumferential direction of the body portion 61 near the upper part of the body portion 61 and in a direction away from the knob portion 14. As shown in FIG. 7, each weakened portion 62 is provided in an inverted L-shape. The arrangement of the weakened portion 62 is not limited to the aforementioned configuration, and may be any arrangement as long as the body portion 61 of the spout cap 60 can be broken.

As shown in FIG. 7, the weakened portion 62 may be formed by providing a perforation in which a part of the body portion 61 is broken, or may be formed by making the thickness of the body portion 61 thinner than other parts.

If the user lifts the knob portion 14 when detaching the spout cap 60 from the spout main body 20, the body portion 61 breaks along each weakened portion 62. Therefore, the spout cap 60 can be more easily detached from the spout main body 20.

Further, when opening the mouth portion 21 of the spout main body 20, since the body portion 61 of the spout cap 60 breaks, the breakage can be regarded as a history of the mouth portion opening. That is, the weakened portion 62 can be used as so-called tamper evidence.

Furthermore, the spout cap 60 and the spout 300 of the second modified example have the same effects as those of the spout cap 10 and the spout 100 described above.

Third Modified Example

Figure 8:
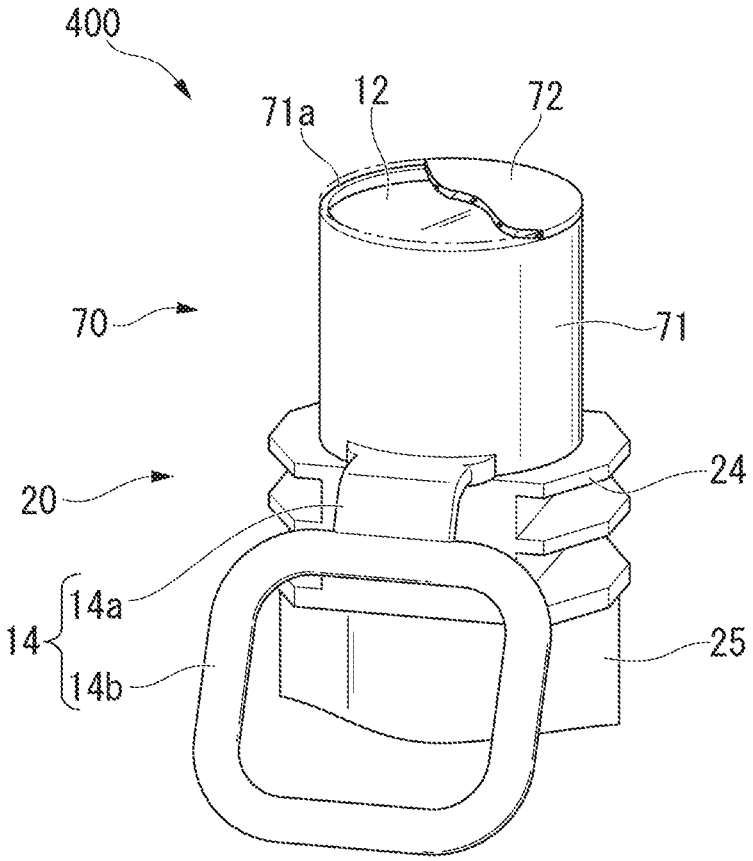
FIG. 8 is a perspective view showing a spout according to a third modified example of the embodiment of the present invention.

FIG. 8 is a perspective view showing a spout 400 according to a third modified example of the present embodiment. As shown in FIG. 8, the spout 400 is provided with a spout main body 20, and a spout cap 70 attached to the spout main body 20. The spout cap 70 of the spout 400 is provided with a cover body 72 disposed at a distal end 71*a* of a body portion 71. Other configurations are the same as those of the above-described spout 100.

In FIG. 8, the cover body 72 is shown with a part thereof broken. The cover body 72 is joined to the distal end 71*a* of the body portion 71, and is provided to cover the sealing film 12. The material of the cover body 72 may be the same as the material of the body portion 71 (the body portion 11).

The cover body 72 can be joined to the distal end 71*a* of the body portion 71 after the sealing film 12 and the mouth portion 21 of the spout main body 20 are thermally joined.

Further, when the sealing film 12 has a metal layer, in a case in which the cover body 72 and the sealing film 12 are extremely close to each other or are in close contact with each other by joining or the like, even in a state in which the cover body 72 is interposed by a method such as a high-frequency seal, the sealing film 12 and the mouth portion 21 of the spout main body 20 can be thermally joined. For this reason, by making the cover body 72 and the sealing film 12 closer to each other by providing the sealing film 12 on a side closer to the distal end 71*a* of the body portion 71, or by making the cover body 72 and the sealing film 12 in contact with each other while setting the size of the cover body 72 to a size dropped into the inner peripheral side of the body portion 71, at the same time as or before the thermal joining between the sealing film 12 and the mouth portion 21 of the spout main body 20, the cover body 72 can also be joined to the body portion 71.

Since the spout cap 70 includes the cover body 72, it is possible to reliably prevent a situation in which an object comes into contact with the sealing film 12 unintentionally and the sealing film 12 breaks.

Furthermore, the spout cap 70 and the spout 400 of the third modified example have the same effects as those of the spout cap 10 and the spout 100 described above.

Next, a container 500 with spout including the spout 100 of the present embodiment will be described.

(Container with Spout)

FIG. 9 is a perspective view showing the container 500 with spout provided with the aforementioned spout 100. The container 500 with spout is provided with the spout 100 and the container main body 101 filled with contents. The container main body 101 is provided with a pair of facing planar portions 102*a* and 102*b*, a pair of facing side gussets 103*a* and 103*b*, a bottom portion 104, and an upper seal portion 105.

The planar portion 102*a* and the planar portion 102*b* are thermally joined and fixed to each other in the upper seal portion 105. The side gusset 103*a* and the side gusset 103*b* are formed to be folded to the inside of the container main body 101. The bottom portion 104 is a portion that becomes a bottom surface when the container 500 with spout is made to stand by itself, and is formed by bending a pair of planar portions 102*a* and 102*b* inward.

In the upper seal portion 105, the planar portion 102*a* and the planar portion 102*b* are fixed to each other by thermal bonding to sandwich the container attachment portion 25 of the spout main body 20. That is, in the upper seal portion 105, since one planar portion 102*a* and the container attachment portion 25 are thermally joined, and the other planar portion 102*b* and the container attachment portion 25 are thermally joined, the spout 100 is fixed to the container main body 101 without gap.

As shown in FIG. 9, in a case in which the knob portion 14 protruding from the body portion 11 of the spout cap 10 is provided, a direction in which the knob portion 14 (belt portion 14*a*) protrudes from the body portion 11 can be set as a direction that forms an angle of 90 degrees with a longitudinal direction of the upper seal portion 105 when viewed from above the spout 100 (the container 500 with spout). Since the knob portion 14 (the belt portion 14*a*) protrudes to be orthogonal to the longitudinal direction of the upper seal portion 105, when the user lifts or pushes up the knob portion 14 in the container 500 with spout to which the spout 100 is attached, the hand of the user and the container main body 101 are hard to interfere with each other, and the operation of detaching the spout cap 10 by the user becomes easier.

The container main body 101 is made of a film material, and can be a laminated film in which at least a base material layer and a thermal bonding layer are laminated, and the innermost layer inside the container main body 101 is a thermal bonding layer.

The same material and configuration as the sealing film 12 can be adopted for the base material layer and the thermal bonding layer. Further, as in the sealing film 12, the container main body 101 can be formed from a laminated film having a metal layer such as aluminum having excellent barrier properties.

By configuring the container 500 with spout, using the container main body 101 made of a laminated film having a metal layer, the spout cap 10 using the sealing film 12 having a metal layer, and the spout main body 20 having a barrier material inside the spout main body 20, the entire container 500 with spout has a barrier property, and it is possible to obtain the container 500 with spout excellent in long-term storage of the contents.

By providing the container 500 with spout including the spout 100 according to the embodiment of the present invention, it is possible to provide a container with spout in which both the reliable closing and easy opening of the mouth portion of the spout main body are obtained.

Although the embodiments of the present invention have been described above, the technical scope of the present invention is not limited to the above-described embodiments, and various changes can be made to or delete each component without departing from the spirit of the present invention.

For example, in the aforementioned embodiment, a groove may be appropriately provided on the inner peripheral surface 11 of the body portion 11 of the spout cap 10, as a loophole for moisture remaining in the gap between the spout cap 10 and the mouth portion 21 of the spout main body 20 at the time of the retort treatment.

Further, in the aforementioned embodiment, the distal end surface 21*a* of the mouth portion 21 of the spout main body 20 is not limited to a flat shape but may be inclined. For example, if the distal end surface 21*a* is inclined upward from aside in which the knob portion 14 is provided (a front side as viewed from the user) to an opposite side (a back side as viewed from the user), the operation of lifting the knob portion 14 and detaching the spout cap 10 from the spout main body 20 becomes smooth. Further, if the distal end surface 21*a* of the mouth portion 21 is inclined, the contents filled in the container 500 with spout can be easily transferred to another container.

If the distal end surface 21*a* of the mouth portion 21 is inclined, the upper surface 13*a* of the pedestal portion 13 of the spout cap 10 may be inclined accordingly to form the same plane as the inclined distal end surface 21*a*.

Further, in the above-described embodiment, a configuration in which the first convex portion 15 and the second convex portion 16 provided on the body portion 11 of the spout cap 10, and the first convex portion 22 and the second convex portion 23 provided on the mouth portion 21 of the spout main body 20 are not provided may be adopted. In such a configuration, the spout cap 10 is attached to the spout main body 20, only by joining between the sealing film 12 joined to the body portion 11 of the spout cap 10 and the mouth portion 21 of the spout main body 20. In the spout having such a configuration, since the spout cap 10 can be detached from the spout main body 20 by peeling off the sealing film 12 from the mouth portion 21 of the spout main body 20, force required when opening the mouth portion 21 of the spout main body 20 can be made very small.

The container 500 with spout may be a self-standing type having a bottom gusset or may be a non-standing type flat bag-shaped container, other than the self-standing type having a side gusset as shown in FIG. 9. Further, a film equal to or different from the planar portions 102*a* and 102*b* may be separately prepared, and the bottom portion 104 may be formed by the film, other than the configuration in which the bottom portion 104 is formed by bending a pair of planar portions 102*a* and 102*b* inside the container main body 101.

DESCRIPTION OF REFERENCE SIGNS

10, 30, 60, 70 Spout cap
11, 31, 61, 71 Body portion
11*a*, 71*a* Distal end
11*b* Proximal end
11*c*, 21*c* Inner peripheral surface
11*d*, 21*d* Outer peripheral surface
12 Sealing film
13 Pedestal portion
13*a* Upper surface
13*b* Lower surface
14 Knob portion
14*a* Belt portion
14*b* Overhang portion
15, 22 First convex portion
16, 23 Second convex portion
20, 40 Spout main body
21 Mouth portion
21*a* Distal end surface
24, 44 Flange portion
25, 45 Container attachment portion
50 Turning prevention mechanism
50*a* Turning prevention concave portion
50*b* Turning prevention convex portion
62 Weakened portion
72 Cover body
100, 200, 300, 400 Spout
101 Container main body
102*a*, 102*b* Planar portion
103*a*, 103*b* Side gusset
104 Bottom portion
105 Upper seal portion
500 Container with spout

The invention claimed is:

1. A spout cap for closing a mouth portion of a spout main body, the spout cap comprising:
a cylindrical body portion made of resin; and
a sealing film joined to the body portion,
wherein the sealing film has a thermal bonding layer which is configured to join to a distal end surface of the mouth portion when the mouth portion is closed,
the body portion includes a pedestal portion provided on an inner peripheral surface of the body portion,
the sealing film is joined to an upper surface of the pedestal portion,
the pedestal portion is provided at a position surrounding the mouth portion when the mouth portion is closed, and
the upper surface of the pedestal portion is provided to be flush with the distal end surface of the mouth portion when the mouth portion is closed.

2. The spout cap according to claim 1, wherein the sealing film has a metal layer.

3. The spout cap according to claim 1, wherein the sealing film is provided below a distal end of the body portion.

4. The spout cap according to claim 1, further comprising:
a cover body disposed at a distal end of the body portion to cover the sealing film.

5. The spout cap according to claim 1, further comprising:
an engaging portion which is provided on the body portion and is configured to engage with the spout main body to prevent the spout cap from detaching from the spout main body.

6. The spout cap according to claim 1, further comprising:
a knob portion joined to the body portion.

7. The spout cap according to claim 1, wherein the body portion is provided with a weakened portion which breaks when the mouth portion is opened.

8. A spout comprising:
the spout cap according to claim 1; and
a spout main body having a mouth portion,
wherein the body portion of the spout cap and the mouth portion of the spout main body are joined by the sealing film.

9. A container with spout comprising:
the spout according to claim 8; and
a container main body which is filled with contents,
wherein the spout and the container main body are thermally joined.

* * * * *